US009913360B1

(12) United States Patent
Antipov et al.

(10) Patent No.: US 9,913,360 B1
(45) Date of Patent: Mar. 6, 2018

(54) METHOD OF PRODUCING BRAZELESS ACCELERATING STRUCTURES

(71) Applicant: Euclid TechLabs, LLC, Solon, OH (US)

(72) Inventors: Sergey Antipov, Naperville, IL (US); Roman Kostin, Naperville, IL (US); Sergey Kuzikov, Nizhny Novgorod Oblast (RU); Chunguang Jing, Naperville, IL (US); Jiaqi Qiu, Willowbrook, IL (US)

(73) Assignee: Euclid TechLabs, LLC, Solon, OH (US)

( * ) Notice: Subject to any disclaimer, the term of this patent is extended or adjusted under 35 U.S.C. 154(b) by 0 days.

(21) Appl. No.: 15/338,569

(22) Filed: Oct. 31, 2016

(51) Int. Cl.

| | |
|---|---|
| ***H05H 7/16*** | (2006.01) |
| ***H05H 9/04*** | (2006.01) |
| ***H05H 7/02*** | (2006.01) |
| ***H05H 7/08*** | (2006.01) |

(52) U.S. Cl.
CPC ..... *H05H 9/048* (2013.01); *H05H 7/02* (2013.01); *H05H 7/08* (2013.01); *H05H 7/16* (2013.01); *H05H 2007/025* (2013.01); *H05H 2007/084* (2013.01)

(58) Field of Classification Search
None
See application file for complete search history.

(56) References Cited

U.S. PATENT DOCUMENTS

| | | | | |
|---|---|---|---|---|
| 4,287,488 | A * | 9/1981 | Brau | H01S 3/0903 359/335 |
| 5,014,014 | A * | 5/1991 | Swenson | H01J 23/24 315/5.41 |
| 5,401,973 | A * | 3/1995 | McKeown | H05H 1/0006 250/396 R |
| 5,434,420 | A * | 7/1995 | McKeown | H05H 1/0006 250/396 R |

(Continued)

OTHER PUBLICATIONS

Roberts et al Harmonically resonant cavity as a bunch-length monitor, Phys Rev Accelerators and beams 19, 052801 (2016).*

(Continued)

*Primary Examiner* — Douglas W Owens
*Assistant Examiner* — Srinivas Sathiraju
(74) *Attorney, Agent, or Firm* — Maine Cernota & Rardin

(57) ABSTRACT

A resonant apparatus such as a resonant waveguide module in an RF particle accelerator includes an unbrazed joint that provides a reliable vacuum seal and RF contact between resonators with precisely controlled internal geometry. The joint can be disassembled and reassembled without degradation. Hard, stainless steel end faces include knife edges pressed into a copper central component, such as a gasket. The knife edges extend the waveguide interiors without gaps or interruptions. The central component serves as a coupling iris or other functional component of the resonant apparatus, thereby allowing the central component to have substantial dimensions that inhibit mechanical distortions thereof. The waveguides and knife edges can be copper plated. Embodiments include embedded passages and/or recesses used for (Continued)

cooling, radiation shielding, magnetic focusing coils, and/or electron optics element formed by permanent magnets.

16 Claims, 7 Drawing Sheets

(56) References Cited

U.S. PATENT DOCUMENTS 5,497,050 A * 3/1996 Cheo ..... H03F 3/60 315/5.41
7,656,094 B2 * 2/2010 Gorrell ..... H05H 15/00 315/5.38
7,898,193 B2 * 3/2011 Miller ..... H05H 7/22 315/5.41
8,111,025 B2 * 2/2012 Whittum ..... H05H 9/04 315/5.39
8,390,403 B1 * 3/2013 Schaffner ..... H01P 5/107 333/250
8,487,556 B2 * 7/2013 Yu ..... H05H 7/22 315/505
8,674,630 B1 * 3/2014 Cornelius ..... H05H 7/20 315/5.41
8,994,297 B2 * 3/2015 Teryaev ..... H01J 25/10 315/500
2009/0140672 A1 * 6/2009 Gall ..... H05H 13/02 315/502
2011/0176648 A1 * 7/2011 Rowland ..... H05H 3/06 376/114

OTHER PUBLICATIONS

C Liu et al "Advanced photon source accelerator ultra high vacuum guide" ANL APS /TB16.*
Erk Jensen "RF Cavity Design" CAS Chios 2011 Sep. 20, 2011.*

* cited by examiner

METHOD OF PRODUCING BRAZELESS ACCELERATING STRUCTURES

FIELD OF THE INVENTION

The invention relates to particle accelerating structures and other high power microwave devices, and more particularly to resonant high power microwave devices that require precise internal dimensioning and a simultaneous RF and vacuum joint.

BACKGROUND OF THE INVENTION

The manufacture of certain resonant devices such as waveguides for particle accelerators and other high power microwave devices is a cumbersome and expensive process, because these devices require that a plurality of modules be interconnected by joints that simultaneously provide precise internal geometries, unbroken RF shielding, and a high vacuum seal. A typical device of this type might include a set of cylindrical resonator cavities connected together with coupling holes that are machined out of copper and then brazed together to achieve both a good vacuum joint as well as good RF contact. This brazed joint process is expensive, and is prone to manufacturing errors, whereby the desired resonant internal geometry is not obtained with sufficient precision or a sufficient vacuum seal is not achieved. Furthermore, if there is a mistake in the brazing process, it is virtually impossible to unbraze and rebraze the assembly. Moreover, thermal stress experienced by copper during brazing increases the probability of electrical breakdown.

Some attempts have been made to construct such resonant devices without brazing. In one case, resonant copper cells were clamped together, whereby an externally applied structure was used to apply and maintain the clamping pressure required to provide good RF contact. The vacuum seal in this case was provided by a separate, external stainless steel container. Accordingly, in this example the RF and vacuum joints were separated, and the resulting assembly was bulky and costly.

Another approach that has been tried is to bolt copper cells together with a softer, annealed copper gasket sandwiched in between the cells. Under ideal conditions, such an assembly can provides a simultaneous RF and vacuum joint that performs well. However, crushing a copper gasket between copper flanges is a delicate procedure, the reliability of which is uncertain. In particular, the relative softness of copper flanges poses a high risk of distorting the internal dimensions of the cells when the flanges are pressed against the gaskets. Also, disassembly and reassembly of such an assembly runs the risk of vacuum and/or RF leaks being introduced.

So-called "conflat" vacuum seal technology is well known to provide high quality vacuum seals that can be safely disassembled and reassembled with almost no degradation. These vacuum seals rely on the joining together of opposing hard, stainless steel flanges, whereby the opposing faces of the flanges include knife edges configured to bite into a thin, soft copper gasket that is sandwiched in between the flanges. However, while the conflat approach provides highly reliable vacuum seals, it is not able to provide reproducible internal geometries that would be sufficiently precise to satisfy the requirements of resonators and waveguides for particle accelerators and other such high power microwave devices.

Similarly, the Stanford Linear Accelerator Center (SLAC) and Compact Linear Collider (CLIC) projects developed various types of crush-seal RF waveguide flanges that featured rectangular lips rather than a waveguide and were able to provide vacuum seals while simultaneously providing good RF contact. However, the rectangular lips used in these designs do not provide a precision crushing thickness. For simple, non-resonant waveguide applications this is not important, but utilizing the same technology for constructing resonators would be problematic, because there would be an unacceptable variability of the resonator length. Furthermore, the situation would be even worse for accelerators, which are essentially arrays of coupled resonators, because the length error would accumulate.

What is needed, therefore, is an unbrazed waveguide module joint structure that provides a low cost joint having precisely controlled internal geometry combined with a reliable vacuum seal and high quality RF shielding, whereby the joint structure can be readily disassembled and reassembled with substantially no degradation.

SUMMARY OF THE INVENTION

An unbrazed joint structure suitable for resonant waveguide modules is disclosed that provides a precisely controlled internal geometry combined with a reliable vacuum seal and high quality RF contact joint, whereby the joint structure can be readily disassembled and reassembled with substantially no degradation.

The disclosed joint structure adopts some features of the conflat design, in that two hard flanges, typically made from stainless steel, are assembled with a soft copper gasket sandwiched in between, and also in that each of the hard flanges includes a knife edge that bites into the copper gasket to form a vacuum seal. In some embodiments, the hard flanges function as resonant cells, referred to herein as "flange-cells." In other embodiments, the flanges are terminating features of longer resonant cells.

The disclosed joint structure differs from the conflat design, in that the hard stainless steel flanges are plated with copper, so that their interiors present a uniform copper environment for low RF loss. In addition, the knife edges are placed at the inner edges of the cavity, and the inward-facing surfaces of the knife edges are flat and parallel to the axis of the cavity, so that each knife edge functionally extends the length of the cavity without introducing any gaps between the gasket and the flange or flange-cell.

In addition, the copper gasket in the disclosed joint structure is not simply a thin, added component necessary to the formation of the vacuum seal. Instead, it is incorporated as a functional component of the resonator or other device being constructed, thereby allowing it to be thicker more rigid than the gaskets used in typical conflat joints.

For example, in embodiments an accelerating structure is comprised of a plurality of resonant stainless steel cells connected sequentially to each other by hard flanges having knife edges that press into intervening copper gaskets, where the gaskets are penetrated by central holes that are smaller than the internal diameters of the cells, such that the gaskets serve as the irises of the accelerating structure. In such embodiments, the gasket is sometimes referred to herein as an "iris-gasket." The knife edges of the cell-flanges in these embodiments are located at the edges of the resonator volumes, such that the internal surfaces of the knife edges serve as continuations of the internal shape of the cell, thereby extending the cell geometry without modifications or gaps until the gasket is encountered. The joint thereby allows for gap-free contacts and results simultaneously in high quality vacuum seals and contact RF joints.

In embodiments, the stainless steel flange-cells are copper plated to fully mimic the performance of a traditional resonant structure comprising copper modules joined by brazing. Tests performed on a structure of this type achieved quality factors comparable to similar brazed accelerating structures made out of copper, and the copper plated stainless steel cell flanges showed no bubbling or delamination of the copper after they were cycled to a temperature of 500 C in a hydrogen furnace.

As noted above, in the present invention the copper gasket, besides being essential to provide simultaneous vacuum and RF joints, also serves as an integral part of the accelerating structure. In resonant accelerating structure embodiments, the copper gaskets serve as the irises. These copper iris-gaskets are consequently thicker and more stable dimensionally as compared to thin copper gaskets used solely for sealing purposes, e.g. in traditional conflat joints.

To summarize, the present invention combines a proven vacuum seal technology (stainless steel knife edge with copper gasket) with an RF design that incorporates the copper gasket as an integral part of the RF resonator, thereby providing a high quality vacuum and RF seal while allowing the copper gasket to be of substantial dimensions that are resistant to deformation, so that the precise dimensional requirements of a resonator design are reproducibly satisfied. In addition, recent advances in the technology of copper plating on stainless steel are incorporated so as to create high quality factor "copper" resonators supported by an underlying stainless steel core.

Advantages of the present invention include elimination of extra material to reduce weight, arrangement of cooling channels very close to where microwave absorption occurs, providing ample space for coolant to circulate, and providing a brazeless design that can reduce production costs of an accelerating waveguide by more than an order of magnitude as compared to typical brazed designs. In particular, the copper plating of stainless included in embodiments of the invention is an inexpensive batch process that does not contribute significantly to the overall cost of the device.

Embodiments of the present invention are applicable to particle accelerators, both for industrial and scientific applications. Embodiments are advantageous for vacuum electronic structures by enabling both cooling and magnetic focusing to be embedded into the cell flanges. Overall, the present invention can be applied to virtually any application of high power microwave components that requires a good RF joint combined with vacuum sealed volumes.

The present invention is a resonant apparatus that includes a first waveguide having therein a first internal channel bounded by first internal walls, said first internal channel extending to and penetrating through a first distal end face of the first waveguide, a first knife edge having flat first inner sides terminating at a distal leading edge, said first inner sides being coincident with and parallel to said first internal walls so as to functionally extend said first internal walls without substantial interruption thereof, a second waveguide having therein a second internal channel bounded by second internal walls, said second internal channel extending to and penetrating through a flat proximal end face of the second waveguide, a second knife edge having flat second inner sides terminating at a proximal leading edge, said second inner sides being coincident with and parallel to said second internal walls so as to functionally extend said second internal walls without substantial interruption thereof, and a central component having a central opening, said central component being made from a metal that is softer than metals from which said knife edges are made. The first and second waveguides are assembled with the central component sandwiched in between, such that the central opening extends between the first and second internal channels, and such that the first and second knife edges are pressed into opposing proximal and distal faces of the central component respectively, thereby simultaneously forming vacuum and RF seals between the first and second waveguides and the central component, where the central component is an element that is functionally necessary to the resonant apparatus.

In embodiments, the first and second knife edges are made from stainless steel, and the central element is made from copper. In any preceding embodiment, the first and second internal walls and the first and second knife edges can be plated with copper, and the central element can be made from copper. In some of these embodiments, the resonant apparatus can be tuned by selective etching of the copper plated internal walls of the waveguides.

In any preceding embodiment, the central opening can be smaller in cross sectional area than cross sectional areas of the first and second channels. And in some of these embodiments the central opening functions as an iris separating the first and second central channels.

In any preceding embodiment, the central element can be a gasket.

In any preceding embodiment, the first waveguide can include a plurality of separated passages or recesses. Some of these embodiments further include a coil wound in one or more passages or recesses of the first waveguide, and/or an electron optics element formed by permanent magnets placed in the passages or recesses, such as a Halbach array, or a quadrupole that does or does not include iron inserts.

In any of the preceding embodiments, the first waveguide can further include a cooling channel. And in any of the preceding embodiments, the first waveguide can further include magnetic beam optics embedded therein.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is an unbrazed joint structure that is suitable for joining together resonant waveguide modules, whereby the joint structure provides a precisely controlled internal geometry suitable for resonant structures, combined with a reliable vacuum seal and high quality RF shielding. The joint structure can be produced at a much lower cost as compared with typical brazed structures, and can be readily disassembled and reassembled with substantially no degradation.

The disclosed joint structure adopts some features of the conflat design, in that two hard flanges, typically made from stainless steel, are assembled with a soft copper gasket sandwiched in between, and also in that each of the hard flanges includes a knife edge that cuts into the copper gasket to form a vacuum seal as well as a reliable RF connection. Unlike typical conflat flanges, however, the hard flanges of the present design are plated with copper. In embodiments entire modular cells, including the central bodies and terminating flanges, are constructed from stainless steel and plated with copper, so that the interiors present a uniformly copper environment for RF shielding. In other embodiments, the flanges themselves function as the resonant cells, and are referred to herein as flange-cells.

Furthermore, the interior surfaces of the knife edges are constructed so as to functionally extend the internal structure of the cell, so that the internal cell geometry is unbroken and unmodified until it encounters the gasket.

Also, the copper gaskets in the disclosed joint structure are not simply added components necessary to the formation of vacuum seals. Instead, they are incorporated as functional RF components of the resonator or other device being constructed, thereby allowing them to be thicker more rigid than the gaskets used in typical conflat joints.

Figure 1:
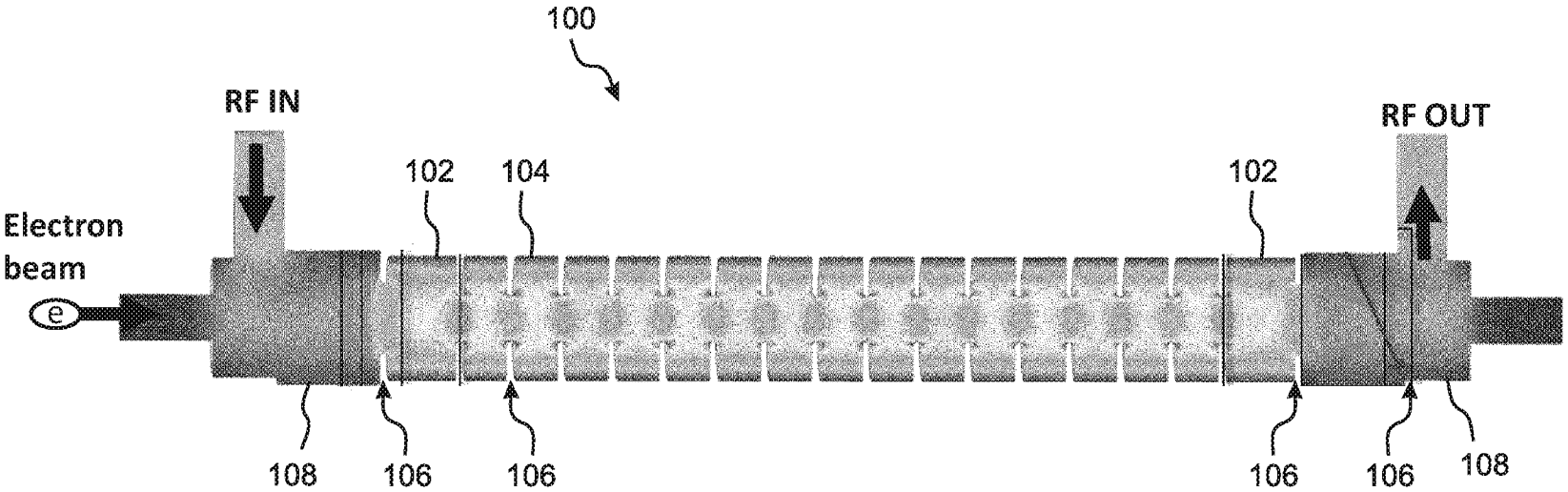
FIG. 1 is side view of a particle accelerator waveguide that includes joints formed according to an embodiment of the present invention.

Referring to FIG. 1, an overall assembly design of a particle accelerating structure 100 in an embodiment of the present invention includes a "mode launcher" 108 and a coupling cell 102 at each end of a "regular corrugation" of resonant amplifying cells 104. A copper gasket 106 that also serves as a coupling iris is inserted between each pair of cells 102, 104.

Figure 2:
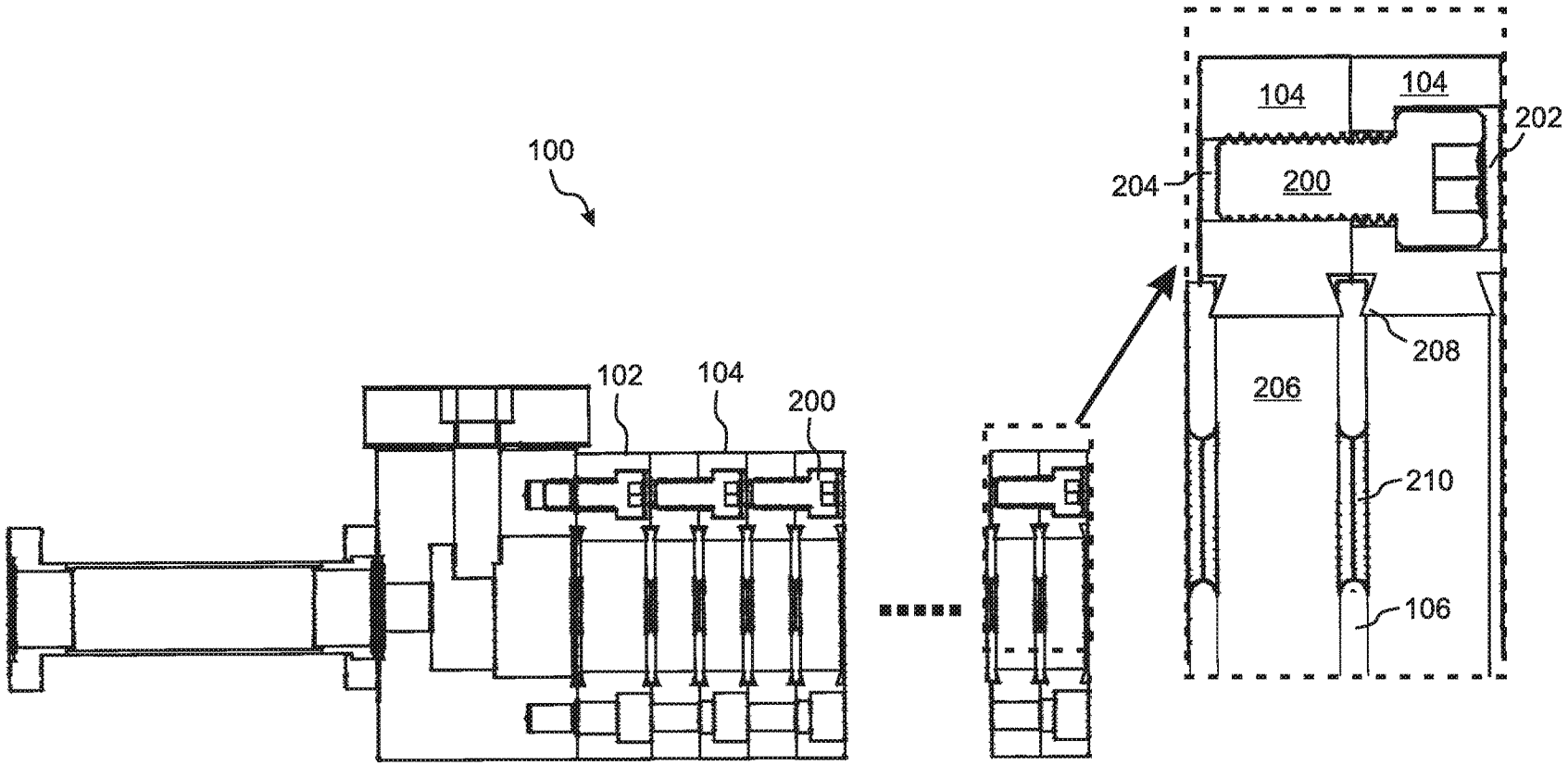
FIG. 2 is an enlarged sectional side view of the particle accelerator waveguide of FIG. 1.

With reference to the sectional view of FIG. 2, due to the short lengths of the cells 102, 104 in this embodiment, separate joining flanges are not required, and instead the cells 102, 104 themselves function as the flanges, whereby each flange-cell 102, 104 includes four bolts 200 inserted through counter-sunk holes 202 and threaded into threaded holes 204 in the next adjoining flange-cell 102, 104.

This structure of the flange-cells and joints can be seen more clearly in the expanded view of two adjacent flange-cells 104 in FIG. 2. Essentially, each accelerating structure cell 102, 104 is a flange having a resonant interior 206 bounded by knife edges 208. The flange-cells 102, 104 are bolted one to another with a copper gasket 106 in between each pair. The gaskets have central holes 210 of reduced diameter, and thereby function as irises (gasket-irises) of the accelerating waveguide assembly 100. The threaded holes 204 in each cell are offset by 45 degrees from the counter-sunk holes 202.

Any number of cells 104 can be strung together in this fashion, depending on the requirements of the embodiment. Flange-cells 102, 104 and gasket-irises 106 can be chosen with appropriate dimensions so as to accommodate a variety of accelerating waveguide designs in terms of phase advance, a necessity for coupling cells 102, irises 106, and mode launchers 108. For example, a low energy accelerating structure that requires a sequential increase of the cell length along the structure can be made in the same brazeless fashion. To be able to crush a copper gasket-iris 106 without distortion, the flange-cells 102, 104 are made of a hard material, such as stainless steel. To maintain the required RF properties, the flange-cells 102, 104 are copper plated.

A standard conflat flange joint introduces gaps in the interior walls of the flanges because the knife edges are offset from the central channel of the flange and thereby space the flanges apart and create gaps between the gaskets and the adjoining flange surfaces. The present invention overcomes this problem by forming the knife edges 208 as extensions of the inner walls of the cavities 206, so that the knife edges 208 effectively represent continuations of the cavities 206. This geometry can be seen in the expanded section of FIG. 2. The interior geometry of the cell cavity 206 is thereby smoothly extended until the gasket-iris 106 is encountered by the knife edge 208.

Figure 3:
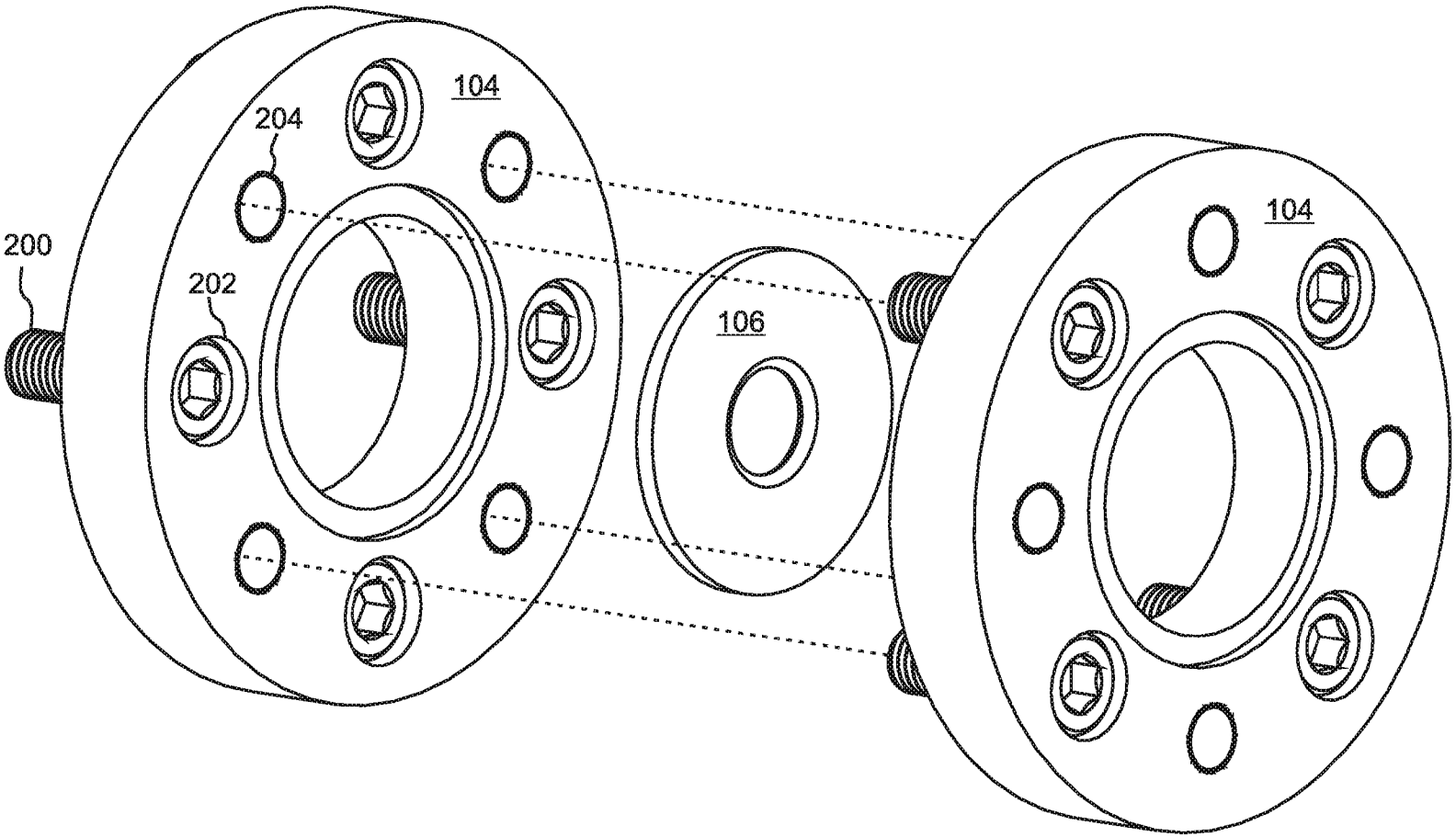
FIG. 3 is an exploded view of a joint included in the embodiment of FIG. 1.

Brazeless assemblies in embodiments of the present invention can be used for ultra-relativistic accelerating structures with identical cells, as shown in FIGS. 1-3 as well as in low energy accelerating structures with irregular cell lengths which accommodate the increase in particle speed as it gains energy. In various embodiments, as shown in FIG. 3, a flange-cell assembly 100 is constructed by successively bolting the flange-cells 102, 104 to each other. In other embodiments, larger groups of cells or even the entire assembly may be assembled in a single step.

Figure 4A:
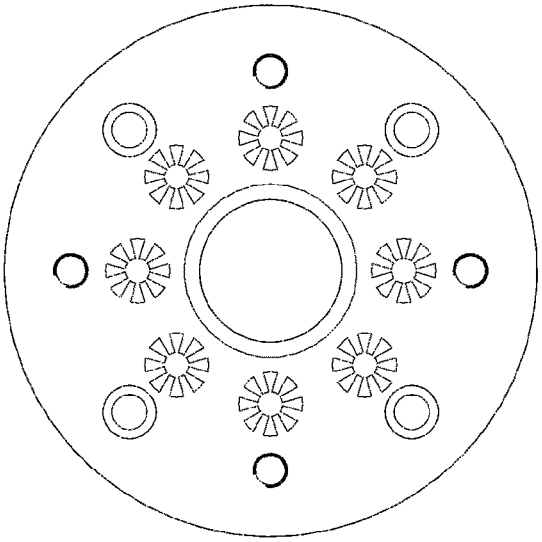
FIG. 4A is a front view of a flange-cell in an embodiment of the invention that includes embedded cooling channels of complicated geometry.
Figure 4B:
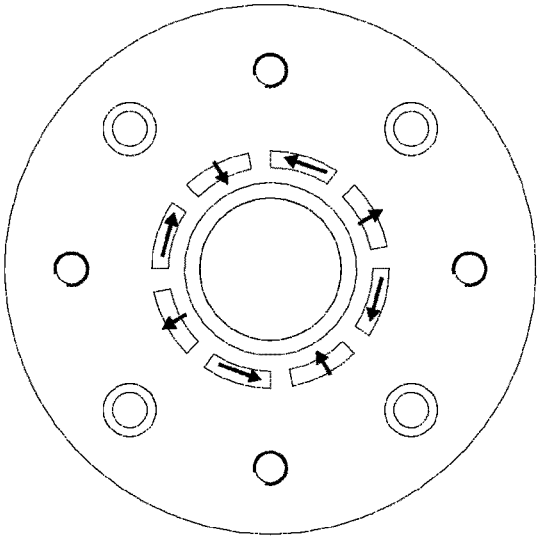
FIG. 4B is a front view of a flange-cell in an embodiment of the invention that includes embedded Halbach array magnetic quadrupole focusing.
Figure 4C:
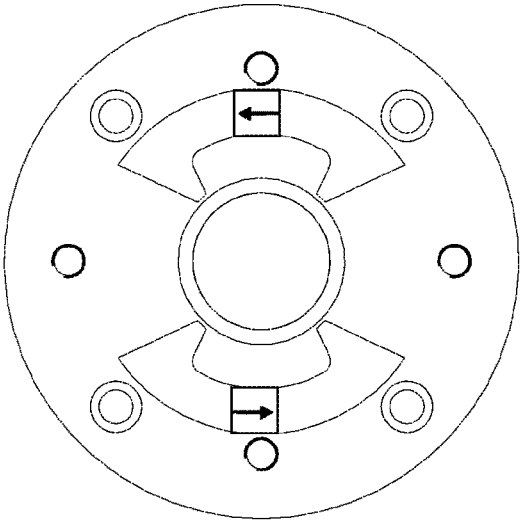
FIG. 4C is a front view of a flange-cell in an embodiment of the invention that includes embedded permanent magnet quadrupole focusing.

While the flange-cells 102, 104 and copper gaskets 106 in the embodiment of FIGS. 1-3 have relatively simple geometries, the flanges and flange-cells in other embodiments have more sophisticated configurations. With reference to FIGS. 4A-4C, in some embodiments the flange-cells include additional passages or recesses that provide, for example, water cooling channels of complicated geometry (FIG. 4A). Magnetic focusing configurations can be provided by placing permanent magnets in the recessed volumes or passages so as to form permanent magnet based electron optics elements such as Halbach arrays (FIG. 4B) and/or quadrupoles with or without iron inserts (FIG. 4C). In various embodiments, coils are wound in the recessed volumes or passages of the flange-cells 102, 104. Excess material can also be removed in this manner for weight management. And in some embodiments, effective gamma ray shielding such as lead plates is embedded within recesses or passages provided within the flange-cells, rather than being wrapped around the outer diameter of the structure.

Combinations of cooling, focusing, and/or shielding are provided in various embodiments with much lower costs of manufacture as compared to conventional milling by creating voids and channels in the resonant cells of the accelerating structure.

Figure 5:
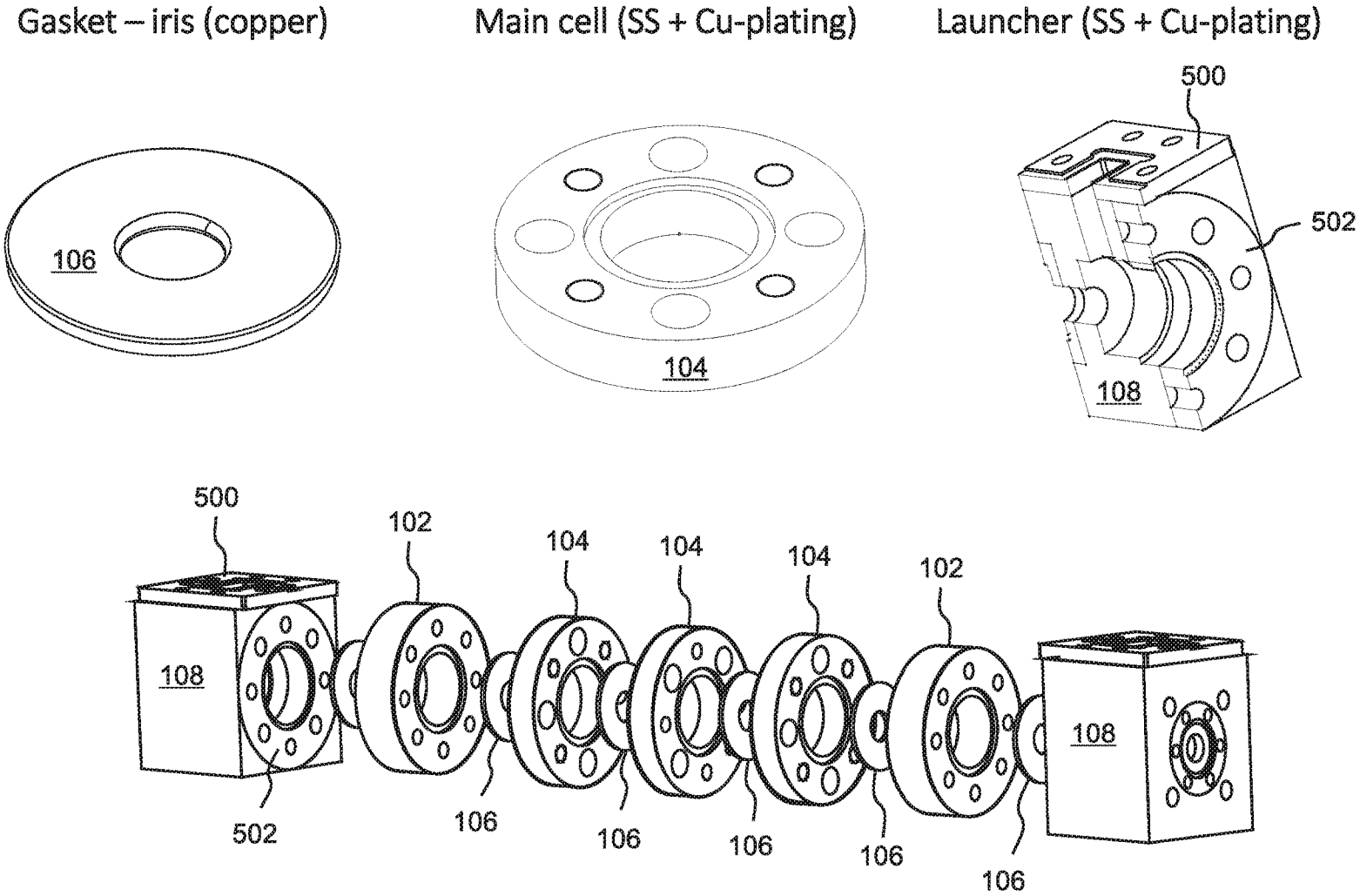
FIG. 5 is an exploded view of a particle waveguide accelerator similar to FIG. 1 that incorporates joints according to embodiments of the present invention.

As is mentioned supra, mode launchers 108 used to deliver RF power into an accelerating waveguide can be made with the same brazeless approach as is used to interconnect the resonant cells 102, 104. This is illustrated in FIG. 5, which is an exploded view of an embodiment similar to FIGS. 1-3. In this embodiment, a mode launcher 108 is machined out of a stainless steel block, and includes an RF flange 500 on the RF side and a flange-cell 502 with a knife edge 208 on the accelerating structure side. The launcher 108 is connected to the accelerating waveguide 100 with a copper gasket-iris 106.

Figure 6:
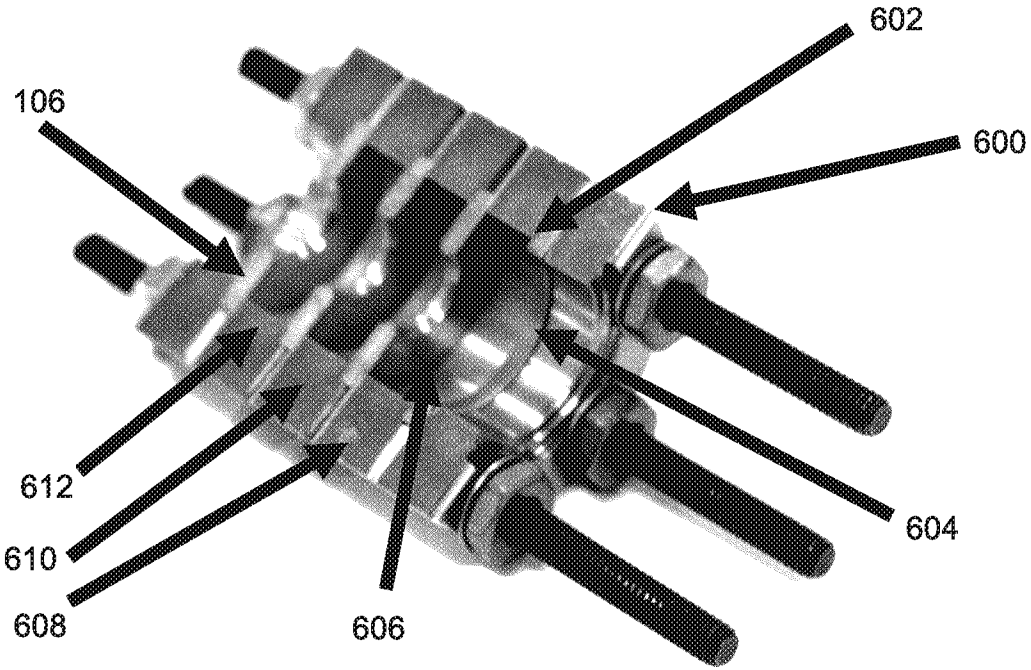
FIG. 6 is a sectional view of a test assembly comprising a conflat joint of the prior art, as well as joints according to embodiments of the present invention that join cells made of unplated stainless steel, stainless steel plated with copper, and stainless steel plated with copper and burn-tested.

FIG. 6 is a photograph of a test assembly of cells that include joints according to the present invention as well as a traditional conflat joint at the lower end. The assembly was prepared, cut in half, and photographed so as to provide a visual comparison between the brazeless assembly principle of the present invention and a standard conflat vacuum assembly. As can be seen in the figure, a standard conflat flange 600 and gasket 602 can provide a vacuum seal, but there is a gap 604 left between them that will cause breakdown and arcing if RF is introduced. A flange-cell 104 of the present invention together with a gasket-iris 106 seals vacuum in the same way the conflat does, but without creating a gap 606. FIG. 6 includes a stainless steel flange-cell that has not been plated 608, a stainless steel cell that has been freshly plated with copper 610, and a flange-cell that has been copper plated and hydrogen burn tested 612. No bubbles or copper delamination is observed on the burn-tested cell, even though it was cycled to a temperature of 500 C in a hydrogen furnace.

Figure 7:
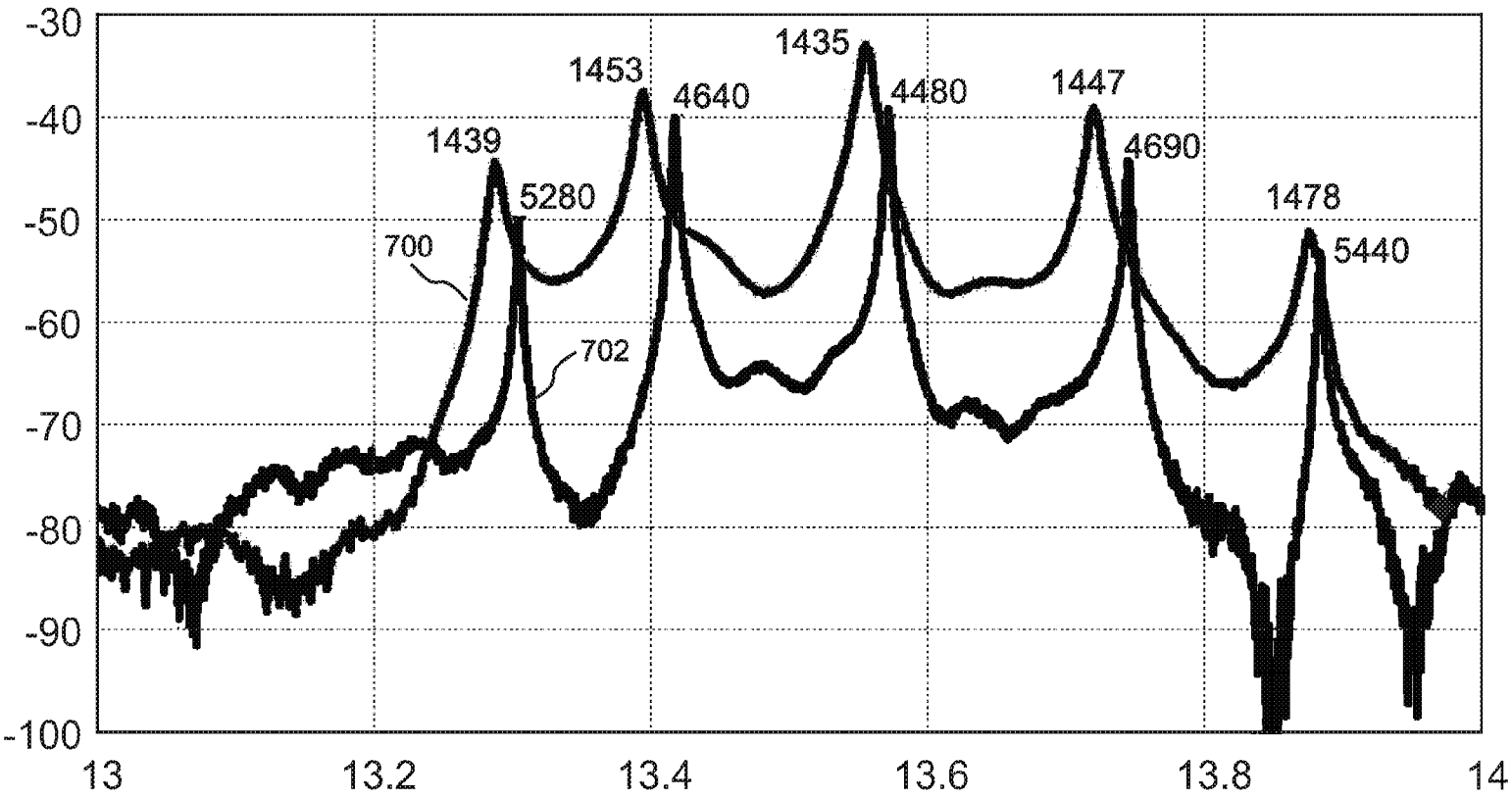
FIG. 7 is a plot comparing resonant curves for a resonant waveguide incorporating embodiments of the present invention obtained before and after plating of the waveguide flange-cells with copper.

FIG. 7 is a graph showing experimental results from tests performed on a 5-cell accelerating structure in an embodiment of the present invention. A set of 5 stainless steel flange-cells was produced along with a set of 5 copper gasket-irises. The structure was bolted together and measured on a network analyzer prior to (700) and following (702) copper plating of the flange-cells. In the zero-transmission measurement, 5 resonances were observed in each case, with quality factors ("Q's") as indicated in the figure. After copper plating, the quality factors of the resonances were found to be identical to those of a brazed solid copper structure of similar dimensions.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application.

The invention illustratively disclosed herein suitably may be practiced in the absence of any element which is not specifically disclosed herein and is not inherently necessary. However, this specification is not intended to be exhaustive. Although the present application is shown in a limited number of forms, the scope of the invention is not limited to just these forms, but is amenable to various changes and modifications without departing from the spirit thereof. One of ordinary skill in the art should appreciate after learning the teachings related to the claimed subject matter contained in the foregoing description that many modifications and variations are possible in light of this disclosure. Accordingly, the claimed subject matter includes any combination of the above-described elements in all possible variations thereof, unless otherwise indicated herein or otherwise clearly contradicted by context. In particular, the limitations presented in dependent claims below can be combined with their corresponding independent claims in any number and in any order without departing from the scope of this disclosure, unless the dependent claims are logically incompatible with each other.

We claim:

1. A resonant apparatus comprising:

a first waveguide having therein a first internal channel bounded by first internal walls, said first internal channel extending to and penetrating through a first distal end face of the first waveguide;

a first knife edge having flat first inner sides terminating at a distal leading edge, said first inner sides being coincident with and parallel to said first internal walls so as to functionally extend said first internal walls without substantial interruption thereof;

a second waveguide having therein a second internal channel bounded by second internal walls, said second internal channel extending to and penetrating through a flat proximal end face of the second waveguide;

a second knife edge having flat second inner sides terminating at a proximal leading edge, said second inner sides being coincident with and parallel to said second internal walls so as to functionally extend said second internal walls without substantial interruption thereof; and a central component having a central opening, said central component being made from a metal that is softer than metals from which said knife edges are made;

said first and second waveguides being assembled with said central component being sandwiched in between, such that said central opening extends between said first and second internal channels, and such that said first and second knife edges are pressed into opposing proximal and distal faces of said central component respectively, thereby simultaneously forming vacuum and RF seals between said first and second waveguides and said central component, said central component being an element that is functionally necessary to said resonant apparatus.

2. The apparatus of claim 1, wherein the first and second knife edges are made from stainless steel, and the central element is made from copper.

3. The apparatus of claim 1, wherein the first and second internal walls and the first and second knife edges are plated with copper, and the central element is made from copper.

4. The apparatus of claim 3, wherein the resonant apparatus can be tuned by selective etching of the copper plated internal walls of the waveguides.

5. The apparatus of claim 1, wherein the central opening is smaller in cross sectional area than cross sectional areas of said first and second channels.

6. The apparatus of claim 5, wherein the central opening functions as an iris separating the first and second central channels.

7. The apparatus of claim 1, wherein the central element is a gasket.

8. The apparatus of claim 1, wherein the first waveguide includes a plurality of separated passages or recesses.

9. The apparatus of claim 8, further comprising a coil wound in one or more of the passages and/or recesses of the first waveguide.

10. The apparatus of claim 8, wherein the first waveguide includes an electron optics element formed by permanent magnets placed in the passages or recesses.

11. The apparatus of claim 10, wherein the electron optics element is a Halbach array.

12. The apparatus of claim 10, wherein the electron optics element is a quadrupole.

13. The apparatus of claim 12, wherein the quadrupole includes iron inserts.

14. The apparatus of claim 1, wherein the resonant apparatus is an RF-driven particle accelerating waveguide.

15. The apparatus of claim 1, wherein the first waveguide further comprises a cooling channel.

16. The apparatus of claim 1, wherein the first waveguide further comprises magnetic beam optics embedded therein.

* * * * *